US008763692B2

(12) United States Patent
Parsche

(10) Patent No.: US 8,763,692 B2
(45) Date of Patent: Jul. 1, 2014

(54) PARALLEL FED WELL ANTENNA ARRAY FOR INCREASED HEAVY OIL RECOVERY

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 434 days.

(21) Appl. No.: 12/950,287

(22) Filed: Nov. 19, 2010

(65) Prior Publication Data

US 2012/0125607 A1 May 24, 2012

(51) Int. Cl.
*E21B 43/24* (2006.01)

(52) U.S. Cl.
USPC ..... 166/248; 166/302; 166/60

(58) Field of Classification Search
USPC ..... 166/248, 60, 302
See application file for complete search history.

(56) References Cited

U.S. PATENT DOCUMENTS

| | | | | |
|---|---|---|---|---|
| 2,371,459 | A | 3/1945 | Mittelmann | |
| 2,685,930 | A | 8/1954 | Albaugh | |
| 3,497,005 | A | 2/1970 | Pelopsky | |
| 3,848,671 | A | 11/1974 | Kern | |
| 3,954,140 | A | 5/1976 | Hendrick | |
| 3,975,617 | A * | 8/1976 | Othmer | 392/469 |
| 4,035,282 | A | 7/1977 | Stuchberry et al. | |
| 4,042,487 | A | 8/1977 | Seguchi | |
| 4,087,781 | A | 5/1978 | Grossi et al. | |
| 4,136,014 | A | 1/1979 | Vermeulen | |
| 4,140,179 | A | 2/1979 | Kasevich et al. | |
| 4,140,180 | A | 2/1979 | Bridges et al. | |
| 4,144,935 | A | 3/1979 | Bridges et al. | |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,328,324 | A | 5/1982 | Kock | |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

"Oil sands." Wikipedia, the free encyclopedia. Retrieved from the Internet from: http://en.wikipedia.org/w/index.php?title=Oil_sands &printable=yes, Feb. 16, 2009.

(Continued)

*Primary Examiner* — David Andrews
(74) *Attorney, Agent, or Firm* — Allen, Dyer, Doppelt, Milbrath & Gilchrist, P.A.

(57) ABSTRACT

A parallel fed well antenna array and method for heating a hydrocarbon formation is disclosed. An aspect of at least one embodiment is a parallel fed well antenna array. It includes an electrically conductive pipe having radiating segments and insulator segments. It also includes a two conductor shielded electrical cable where the shield has discontinuities such that the first conductor and the second conductor are exposed. The first conductor is electrically connected to the conductive pipe and the second conductor is electrically connected to the shield of the electrical cable just beyond an insulator segment of the conductive well pipe A radio frequency source is configured to apply a signal to the electrical cable.

15 Claims, 10 Drawing Sheets

(56) References Cited

U.S. PATENT DOCUMENTS

| | | | | |
|---|---|---|---|---|
| 4,373,581 | A | 2/1983 | Toellner | |
| 4,396,062 | A | 8/1983 | Iskander | |
| 4,410,216 | A | 10/1983 | Allen | |
| 4,425,227 | A | 1/1984 | Smith | |
| 4,449,585 | A | 5/1984 | Bridges et al. | |
| 4,457,365 | A | 7/1984 | Kasevich et al. | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,827 | A | 6/1985 | Bridges | |
| 4,531,468 | A | 7/1985 | Simon | |
| 4,583,586 | A | 4/1986 | Fujimoto et al. | |
| 4,620,592 | A * | 11/1986 | Perkins | 166/245 |
| 4,620,593 | A | 11/1986 | Haagensen | |
| 4,622,496 | A | 11/1986 | Dattili | |
| 4,678,034 | A | 7/1987 | Eastlund | |
| 4,703,433 | A | 10/1987 | Sharrit | |
| 4,790,375 | A | 12/1988 | Bridges | |
| 4,817,711 | A | 4/1989 | Jeambey | |
| 4,882,984 | A | 11/1989 | Eves, II | |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,136,249 | A | 8/1992 | White | |
| 5,233,306 | A | 8/1993 | Misra | |
| 5,236,039 | A | 8/1993 | Edelstein | |
| 5,251,700 | A | 10/1993 | Nelson | |
| 5,293,936 | A | 3/1994 | Bridges | |
| 5,304,767 | A | 4/1994 | MacGaffigan | |
| 5,315,561 | A | 5/1994 | Grossi | |
| 5,370,477 | A | 12/1994 | Bunin | |
| 5,378,879 | A | 1/1995 | Monovoukas | |
| 5,506,592 | A | 4/1996 | MacDonald | |
| 5,582,854 | A | 12/1996 | Nosaka | |
| 5,621,844 | A | 4/1997 | Bridges | |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,097,262 | A | 8/2000 | Combellack | |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,603,309 | B2 | 8/2003 | Forgang | |
| 6,613,678 | B1 | 9/2003 | Sakaguchi | |
| 6,614,059 | B1 | 9/2003 | Tsujimura et al. | |
| 6,649,888 | B2 | 11/2003 | Ryan et al. | |
| 6,712,136 | B2 | 3/2004 | de Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 | 12/2007 | Kinzer | |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,562,708 | B2 | 7/2009 | Cogliandro | |
| 7,623,804 | B2 | 11/2009 | Sone | |
| 2002/0032534 | A1 | 3/2002 | Regier | |
| 2004/0031731 | A1 | 2/2004 | Honeycutt | |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla | |
| 2008/0143330 | A1 | 6/2008 | Madio | |
| 2009/0009410 | A1 | 1/2009 | Dolgin et al. | |
| 2009/0050318 | A1 | 2/2009 | Kasevich | |

FOREIGN PATENT DOCUMENTS

| | | | |
|---|---|---|---|
| EP | 0 135 966 | | 4/1985 |
| EP | 0418117 | A1 | 3/1991 |
| EP | 0563999 | A2 | 10/1993 |
| EP | 1106672 | A1 | 6/2001 |
| FR | 1586066 | A | 2/1970 |
| FR | 2925519 | A1 | 6/2009 |
| GB | 2341442 | | 3/2000 |
| JP | 56050119 | A | 5/1981 |
| JP | 2246502 | A | 10/1990 |
| JP | 11325376 | | 11/1999 |
| WO | WO 2007/133461 | | 11/2007 |
| WO | WO2008/011412 | A2 | 1/2008 |
| WO | WO 2008/030337 | | 3/2008 |
| WO | WO2008098850 | A1 | 8/2008 |
| WO | WO2009027262 | A1 | 8/2008 |
| WO | WO2009/114934 | A1 | 9/2009 |

OTHER PUBLICATIONS

Sahni et al., "Electromagnetic Heating Methods for Heavy Oil Reservoirs." 2000 Society of Petroleum Engineers SPE/AAPG Western Regional Meeting, Jun. 19-23, 2000.

Power et al., "Froth Treatment: Past, Present & Future." Oil Sands Symposium, University of Alberta, May 3-5, 2004.

Flint, "Bitumen Recovery Technology A Review of Long Term R&D Opportunities." Jan. 31, 2005. LENEF Consulting (1994) Limited.

"Froth Flotation." Wikipedia, the free encyclopedia. Retrieved from the internet from: http://en.wikipedia.org/wiki/Froth_flotation, Apr. 7, 2009.

"Relative static permittivity." Wikipedia, the free encyclopedia. Retrieved from the Internet from http://en.wikipedia.org/w/index/php?title=Relative_static_permittivity&printable=yes, Feb. 12, 2009.

"Tailings." Wikipedia, the free encyclopedia. Retrieved from the Internet from http://en.wikipedia.org/w/index.php?title=Tailings&printable=yes, Feb. 12, 2009.

"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.

Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045.

Sahni et al., "Electromagnetic Heating Methods for Heavy Oil Reservoirs," U.S. Department of Energy, Lawrence Livermore National Laboratory, May 1, 2000, UCL-JC-138802.

Abernethy, "Production Increase of Heavy Oils by Electromagnetic Heating," The Journal of Canadian Petroleum Technology, Jul.-Sep. 1976, pp. 91-97.

Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.

(56) References Cited

OTHER PUBLICATIONS

Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC.
A. Godio: "Open ended-coaxial Cable Measurements of Saturated Sandy Soils", American Journal of Environmental Sciences, vol. 3, No. 3, 2007, pp. 175-182, XP002583544.
Carlson et al., "Development of the I IT Research Institute RF Heating Process for In Situ Oil Shale/Tar Sand Fuel Extraction—An Overview", Apr. 1981.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
PCT International Search Report and Written Opinion in PCT/US2010/025765, Jun. 30, 2010.
PCT International Search Report and Written Opinion in PCT/US2010/025772, Aug. 9, 2010.
U.S. Appl. No. 12/886,338, filed Sep. 20, 2010 (unpublished).
Butler, R.M. "Theoretical Studies on the Gravity Drainage of Heavy Oil During In-Situ Steam Heating", Can J. Chem Eng, vol. 59, 1981.
Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.
Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.
Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K, Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.

(56) References Cited

OTHER PUBLICATIONS

Sresty, G.C., Dev, H., Snow, R.H. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.
United States Patent and Trademark Office, Non-final Office action issued in U.S. Appl. No. 12/396,247, dated Mar. 28, 2011.
United States Patent and Trademark Office, Non-final Office action issued in U.S. Appl. No. 12/396,284, dated Apr. 26, 2011.
Patent Cooperation Treaty, Notification of Transmittal of the International Search Report and The Written Opinion of the International Searching Authority, or the Declaration, in PCT/US2010/025808, dated Apr. 5, 2011.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers, © 1986.

* cited by examiner

PARALLEL FED WELL ANTENNA ARRAY FOR INCREASED HEAVY OIL RECOVERY

BACKGROUND OF THE INVENTION

The present invention relates to heating a geological formation for the extraction of hydrocarbons, which is a method of well stimulation. In particular, the present invention relates to an advantageous radio frequency (RF) applicator and method that can be used to heat a geological formation to extract heavy hydrocarbons.

As the world's standard crude oil reserves are depleted, and the continued demand for oil causes oil prices to rise, oil producers are attempting to process hydrocarbons from bituminous ore, oil sands, tar sands, oil shale, and heavy oil deposits. These materials are often found in naturally occurring mixtures of sand or clay. Because of the extremely high viscosity of bituminous ore, oil sands, oil shale, tar sands, and heavy oil, the drilling and refinement methods used in extracting standard crude oil are typically not available. Therefore, recovery of oil from these deposits requires heating to separate hydrocarbons from other geologic materials and to maintain hydrocarbons at temperatures at which they will flow.

Current technology heats the hydrocarbon formations through the use of steam and sometimes through the use of RF energy to heat or preheat the formation. Steam has been used to provide heat in-situ, such as through a steam assisted gravity drainage (SAGD) system. Steam enhanced oil recovery can not be suitable for permafrost regions due to surface melting, in stratified and thin pay reservoirs with rock layers, where there is insufficient caprock, where there are insufficient water resources to make steam, and steam plant deployment can delay production. At well start up, for example, the initiation of the steam convection can be slow and unreliable, as conductive heating in hydrocarbon ores is slow. Radio frequency electromagnetic heating is known for speed and penetration so unlike steam, conducted heating to initiate convection can not be required. The increased speed of production can increase profits. RF heating can be used to initiate convection for steam heated wells or used alone.

A list of possibly relevant patents and literature follows:

| | |
|---|---|
| US2007/0187089 | Bridges |
| US 2008/0073079 | Tranquilla et al. |
| 2,685,930 | Albaugh |
| 3,954,140 | Hendrick |
| 4,140,180 | Bridges et al. |
| 4,144,935 | Bridges et al. |
| 4,328,324 | Kock et al. |
| 4,373,581 | Toellner |
| 4,410,216 | Allen |
| 4,457,365 | Kasevich et al. |
| 4,485,869 | Sresty et al. |
| 4,508,168 | Heeren |
| 4,524,827 | Bridges et al. |
| 4,620,593 | Haagensen |
| 4,622,496 | Dattilo et al. |
| 4,678,034 | Eastlund et al. |
| 4,790,375 | Bridges et al. |
| 5,046,559 | Glandt |
| 5,082,054 | Kiamanesh |
| 5,236,039 | Edelstein et al. |
| 5,251,700 | Nelson et al. |
| 5,293,936 | Bridges |
| 5,370,477 | Bunin et al. |
| 5,621,844 | Bridges |
| 5,910,287 | Cassin et al. |
| 6,046,464 | Schetzina |
| 6,055,213 | Rubbo et al. |
| 6,063,338 | Pham et al. |

-continued

| | |
|---|---|
| 6,112,273 | Kau et al. |
| 6,229,603 | Coassin, et al. |
| 6,232,114 | Coassin, et al. |
| 6,301,088 | Nakada |
| 6,360,819 | Vinegar |
| 6,432,365 | Levin et al. |
| 6,603,309 | Forgang, et al. |
| 6,613,678 | Sakaguchi et al. |
| 6,614,059 | Tsujimura et al. |
| 6,712,136 | de Rouffignac et al. |
| 6,808,935 | Levin et al. |
| 6,923,273 | Terry et al. |
| 6,932,155 | Vinegar et al. |
| 6,967,589 | Peters |
| 7,046,584 | Sorrells et al. |
| 7,109,457 | Kinzer |
| 7,147,057 | Steele et al. |
| 7,172,038 | Terry et al |
| 7,322,416 | Burris, II et al. |
| 7,337,980 | Schaedel et al. |
| 7,562,708 | Cogliandro et al. |
| 7,623,804 | Sone et al. |
| Development of the IIT Research Institute RF Heating Process for In Situ Oil Shale/Tar Sand Fuel Extraction—An Overview | Carlson et al. |

SUMMARY OF THE INVENTION

A parallel fed well antenna array and method for heating a hydrocarbon formation is disclosed. The array includes an electrically conductive pipe having radiating segments and insulator segments. It also includes a two conductor shielded electrical cable where the shield has discontinuities to expose the first conductor and the second conductor. The first conductor is electrically connected to the conductive pipe and the second conductor is electrically connected to the shield of the electrical cable just beyond an insulator segment of the conductive well pipe A radio frequency source is configured to apply a signal to the electrical cable. A nonconductive sleeve covers a portion of the electrically conductive pipe and the electrical cable to keep that section of the device electrically neutral.

Another aspect of at least one embodiment is an alternative parallel fed antenna array that can be retrofit to existing well pipes because it doesn't require insulator segments on the well pipe. Rather, it includes an electrically conductive pipe and a two conductor shielded electrical cable where the shield has discontinuities such that the first conductor and the second conductor are exposed. Both the first conductor and the second conductor are electrically connected to the conductive pipe. A radio frequency source is configured to apply a signal to the electrical cable. A nonconductive sleeve covers a portion of the electrically conductive pipe and the electrical cable to keep that section of the device electrically neutral.

Yet another aspect of at least one embodiment involves a method for heating a hydrocarbon formation. In the first step a two conductor shielded electrical cable is coupled to a conductive well pipe. A radio frequency signal is then applied to the electrical cable that is sufficient to create a circular magnetic field relative to the axis of the conductive well pipe.

Other aspects of certain disclosed embodiments will be apparent from this disclosure.

DETAILED DESCRIPTION OF THE PREFERRED EMBODIMENTS

Figure 1:
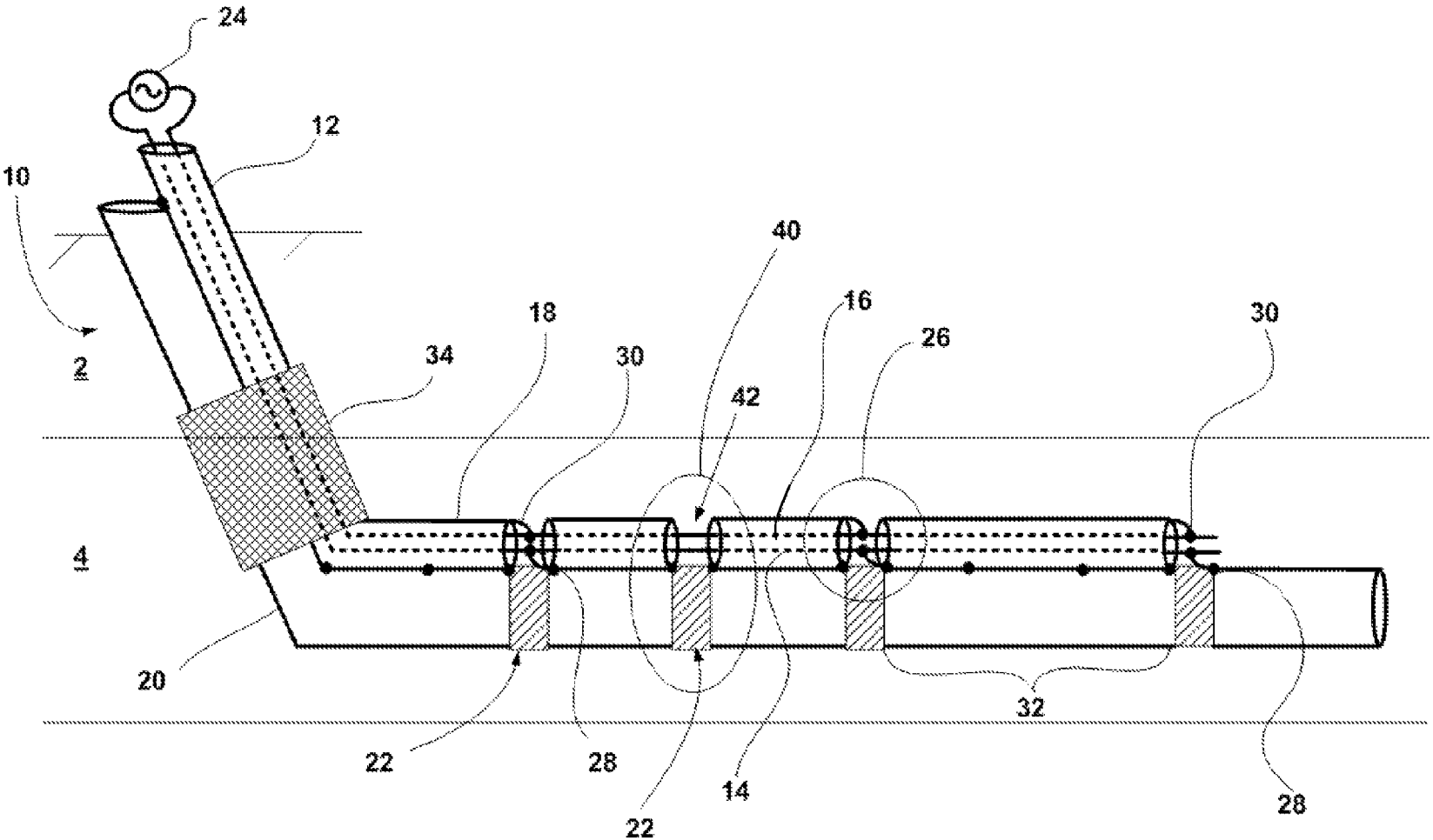
FIG. 1 is a diagrammatic perspective view of an embodiment of parallel fed well antenna array applicator system.

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

Radio frequency (RF) heating is heating using one or more of three energy forms: electric currents, electric fields, and magnetic fields at radio frequencies. Depending on operating parameters, the heating mechanism can be resistive by Joule effect or dielectric by molecular moment. Resistive heating by Joule effect is often described as electric heating, where electric current flows through a resistive material. Dielectric heating occurs where polar molecules, such as water, change orientation when immersed in an electric field. Magnetic fields also heat electrically conductive materials through induction of eddy currents, which heat resistively by joule effect.

RF heating can use electrically conductive antennas to function as heating applicators. The antenna is a passive device that converts applied electrical current into electric fields, magnetic fields, and electrical current fields in the target material, without having to heat the structure to a specific threshold level. Preferred antenna shapes can be Euclidian geometries, such as lines and circles. Line shaped antennas can fit the linear geometry of hydrocarbon wells and the line shaped antenna can supply magnetic fields for induction of eddy currents, source electric currents by electrode contact for resistive heating, and supply electric fields for electric induction of displacement currents. Additional background information on linear antennas can be found at S. K. Schelkunoff & H. T. Friis, *Antennas: Theory and Practice*, pp 229-244, 351-353 (Wiley New York 1952). The radiation patterns of antennas can be calculated by taking the Fourier transforms of the antennas' electric current flows. Modern techniques for antenna field characterization can employ digital computers and provide for precise RF heat mapping.

Susceptors are materials that heat in the presence of RF energy. Salt water is a particularly good susceptor for RF heating; it can respond to all three types of RF energy. Oil sands and heavy oil formations commonly contain connate liquid water and salt in sufficient quantities to serve as an RF heating susceptor. For instance, in the Athabasca region of Canada and at 1 KHz frequency, rich oil sand (15% bitumen) can have about 0.5-2% water by weight, an electrical conductivity of about 0.01 s/m (siemens/meter), and a relative dielectric permittivity of about 120. As bitumen melts below the boiling point of water at reservoir conditions, liquid water can be a used as an RF heating susceptor during bitumen extraction, permitting well stimulation by the application of RF energy. In general, RF heating can have superior penetration to conductive heating in hydrocarbon formations and superior speed. It might require months for conducted heat to penetrate 10 meters in hydrocarbon ore while RF heating energy can penetrate the same distance in microseconds.

RF heating can also have properties of thermal regulation because steam is a not an RF heating susceptor. Thus, electromagnetic energy can be used to heat the water in place in the hydrocarbon ore and the water can then heat the hydrocarbons by conduction. Electromagnetic energy generally heats liquid water much faster than hydrocarbons by a factor of 100 or more. The microstructure of Athabasca oil sand consists of bitumen films covering pores of water with sand cores. In other words, each sand grain is in water drop, and the water drop is covered with bitumen. RF heating the core water mobilizes the oil by reducing its viscosity. The RF stimulated well generally produces the oil and water together, which are then separated at the surface. Heating subsurface heavy oil bearing formations by prior RF systems has been inefficient, in part, because prior systems use resistive heating techniques, which require the RF applicator to be in contact with water in order to heat the formation. Liquid water contact can be unreliable because live oil can deposit nonconductive asphaltines on the electrode surfaces and because the water can boil off the surfaces. Heating an ore region through primarily inductive heating, both electric and magnetic, is an advantage of certain disclosed embodiments.

FIG. 1 shows a diagrammatic representation of an embodiment. An aspect of the invention is a parallel fed well antenna array, which creates an RF applicator that can be used, for example, to heat a hydrocarbon formation. The applicator system generally indicated at 10 extends through an overburden region 2 and into an ore region 4. Throughout the ore region 4 the applicator is generally linear and can extend horizontally over one kilometer in length. In accordance with this invention, electromagnetic radiation provides heat to the hydrocarbon formation, which allows heavy hydrocarbons to flow. The hydrocarbons can then be captured by one or more extraction pipes (not shown) located within or adjacent to the ore region 4, or the system can include pumps or other mechanisms to drain the heated hydrocarbons.

The applicator system 10 includes an electrical cable 12, which has a first conductor 14, a second conductor 16, and a shield 18. The applicator also includes a conductive well pipe 20 with insulator segments 22 and radiating segments 32, an RF source 24, connection sites 26, first conductive jumpers 28, second conductive jumpers 30, and a magnetic sleeve 34.

The electrical cable 12 can be any known two conductor shielded electrical cable. The shield prevents unwanted heating of the overburden and allows the electrical currents to be distributed to any number and length of well pipe segments in the ore region 4. As a practical matter, the electrical cable 12 resistance should be much less than the load resistance of ore region 4. Shielded cables are generally required to convey electrical power through earth at radio frequencies.

The conductive well pipe 20 can be made of any conductive metal, but in most instances will be a typical steel well pipe. The conductive well pipe can include a highly conductive coating, such as copper. In the embodiment shown in FIG. 1, the well pipe has several insulator segments 22. The insulator segments 22 can be comprised of any electrically nonconductive material, such as, for example, plastic or fiberglass pipe. The insulator segments 22 can also be formed by installing or positioning a ferrite bead over sections of the outside of the conductive well pipe 20. The insulator segments 22 function to separate different sections of the well pipe 20, which form the radiating segments 32, so as to provide electrical discontinuities along the length of the pipe 20.

The RF source 24 is connected to the electrical cable 12 through the first conductor 14 and the second conductor 16 and is configured to apply a signal with a frequency f to the electrical cable 12. In practice, frequencies between 1 kHz and 10 MHz can be effective to heat a hydrocarbon formation, although the most efficient frequency at which to heat a particular formation can be affected by the composition of the ore region 4. It is contemplated that the frequency can be adjusted according to well known electromagnetic principles in order to heat a particular hydrocarbon formation more efficiently. Simulation software indicates that the RF source 16 can be operated effectively at 2 Megawatts to 10 Megawatts power for a 1 km long well, so an example of a metric for a formation in the Athabasca region of Canada can be to apply about 2 to 10 kilowatts of RF power per meter of well length initially and to do so for 1 to 4 months to start up the well. Production power levels can be reduced to about ten percent to twenty percent of this amount or steam can be used after RF startup. The RF source 16 can include a transmitter and an impedance matching coupler including devices such as transformers, resonating capacitors, inductors, and other well known components to conjugate match, correct power factor, and manage the dynamic impedance changes of the ore load as it heats. The RF source 16 can also be an electromechanical device such as a multiple pole alternator or a variable reluctance alternator with a slotted rotor that modulates coupling between two inductors. The rim of the slotted rotor can rotate at supersonic speeds to produce radio frequency alternating current at frequencies between 1 and 100 KHz. The RF source 16 can also be a vacuum tube device, such as an Eimac 8974/X-2159 power tetrode or an array of solid state devices. Thus, there are many options to realize RF source 16.

The first conductor 14 is electrically connected to the conductive well pipe 20 at one or more connection sites 26. A connection site 26 is a section of the electrical cable 12 where the shield 18 has been stripped away to allow access to the first conductor 14 and the second conductor 16, and generally occurs near an insulator segment 22. For example, the first conductor 14 can be connected to the conductive well pipe 20 through a first conductive jumper 28. The first conductive jumper 28 can be, for example, a copper wire, a copper pipe, a copper strap, or other conductive metal. The first conductive jumper 26 feeds current from the first conductor 14 onto the conductive well pipe 26 just beyond an insulator segment 22.

Similarly, the second conductor 16 is electrically connected to the shield 18 at one or more connection sites 26. For example, the second conductor 16 can be connected to the shield 18 through a second conductive jumper 30. The second conductive jumper 30 can be, for example, a copper wire, a copper pipe, a copper strap, or other conductive metal. Connecting the second conductive jumper 30 to the shield 18 completes the closed electrical circuit, as described below.

In operation, the first conductor 14, the first conductive jumper 28, the conductive well pipe 20, the second conductor 16, the second conductive jumper 30, and the shield 18 create a closed electrical circuit, which is an advantage because the combination of these features allows the applicator system 10 to generate magnetic near fields so the antenna need not to have conductive electrical contact with the ore. The closed electrical circuit provides a loop antenna circuit in the linear shape of a dipole. The linear dipole antenna is practical to install in the long, linear geometry of oil well holes whereas circular loop antennas can be impractical or nearly so. The conductive well pipe 20 itself functions as an applicator to heat the surrounding ore region 4.

When the applicator system 10 is operated, current I flows through a radiating segment 32, which creates a circular magnetic induction field H, which expands outward radially with respect to a radiating segment 32. A magnetic field H in turn creates eddy currents $I_e$, which heat the ore region 4 and cause heavy hydrocarbons to flow. The operative mechanisms are Ampere's Circuital Law:

$$\int B \cdot dl$$

and Lentz's Law $$\delta W = W \cdot B$$

to form the magnetic near field and the eddy current respectively. The magnetic field can reach out as required from the applicator 10, through electrically nonconductive steam saturation areas, to reach the hydrocarbon face at the heating front.

For certain embodiments and formations, the strength of the heating in the ore due to the magnetic fields and eddy currents is proportional to:

$$P = \pi^2 B^2 d^2 f^2 / 12 \rho D$$

Where:

P=power delivered to the ore in watts

B=magnetic flux density generated by the well antenna in Teslas d=the diameter of the well pipe antenna in meters ρ=the resistivity of the hydrocarbon ore in ohms=1/σ f=the frequency in Hertz

D=the magnetic permeability of the hydrocarbon ore

The strength of the magnetic flux density $B_\Phi$ generated by the well antenna derives from Ampere's law and is given by:

$$B_\Phi = \mu I L e^{-jkr} \sin\theta / 4\pi r^2$$

Where:

B=magnetic flux density generated by the well antenna in Teslas

μ=magnetic permeability of the ore

I=the current along the well antenna in amperes

L=length of antenna in meters $e^{-jkr}$=Euler's formula for complex analysis=cos(kr)+j sin (kr)

θ=the angle measured from the well antenna axis (normal to well is 90 degrees)

r=the radial distance outwards from the well antenna in meters

The magnetic field can reach out as required from the conductive well pipe 20, through electrically nonconductive steam saturation areas, to reach the hydrocarbon face at the heating front. Simulations have shown that as the current I flows along a radiating segment 32, it dissipates along the length of the radiating segment 32, thereby creating a less effective magnetic field H at the far end of a radiating segment 32 with respect to the radio frequency source 24. Thus, the length of a radiating segment 32 can be about 35 meters or less for effective operation when the applicator 10 is operated at about 1 to 10 kHz. However, the length of a radiating segment 32 can be greater or smaller depending on a particular applicator 10 used to heat a particular ore region 4. A preferred length for a radiating segment 32 is approximately:

$$\delta=\sqrt{(2/\sigma\omega\mu)}$$

Where:

$\delta$=the RF skin depth $\sigma$=the electrical conductivity of the underground ore in mhos/meter $\omega$=the angular frequency of the RF current source 16 in radians=$2\pi$(frequency in hertz)

$\mu$=the absolute magnetic permeability of the conductor=$\mu_o\mu_r$

The applicator system 10 can extend one kilometer or more horizontally through the ore region 4. Thus, in practice an applicator system 10 can consist of an array of twenty (20) or more radiating segments 32 connected by insulator segments 22, depending on the electrical conductivity of the underground formation, so the applicator system 10 provides a modular method of construction. The conductivity of Athabasca oil sand bitumen ores can be between 0.002 and 0.2 mhos per meter depending on hydrocarbon content. The richer ores are less electrically conductive. In general, the radiating segments 32 are electrically small, for example, they are much shorter than both the free space wavelength and the wavelength in the media they are heating. The array formed by the radiating segments 32 is excited by approximately equal amplitude and equal phase currents. The realized current distribution along the array of radiating segments 32 forming the applicator 10 can initially approximate a shallow serrasoid (sawtooth), and a binomial distribution after steam saturation temperatures is reached in the formation. Varying the frequency of the RF source 16 is a method of certain disclosed embodiments to approximate a uniform distribution for even heating.

The magnetic sleeve 34 surrounds the electrical cable 12 and the conductive well pipe 20 in, optionally all the way through, the overburden region 2. The magnetic sleeve 34 can be made up of a variety of materials, and it preferentially is bulk electrically nonconductive (or nearly so) and it has a high magnetic permeability. For example, it can be comprised of a bulk nonconductive magnetic grout. A bulk nonconductive magnetic grout can be composed of, for example, a magnetic material and a vehicle. The magnetic material can be, for example, nickel zinc ferrite powder, pentacarbonyl E iron powder, powdered magnetite, iron filings, or any other magnetic material. The particles of magnetic material can have an electrically insulative coating such as $FePO_4$ (Iron Phosphate) to eliminate eddy currents. The vehicle can be, for example, silicone rubber, vinyl chloride, epoxy resin, or any other binding substance. The vehicle can also be a cement, such as Portland cement, which can additionally seal the well casings into the underground formations while simultaneously containing the magnetic medium. At sufficiently low frequencies, the nonconductive sleeve can also use lamination techniques to control eddy currents therein. The laminations can comprise layers of magnetic sheet metal with electrical insulation between them such as silicon steel sheets with insulating varnishes. Other laminations can include windings of magnetic wire or magnetic strip with electrical insulation. Alternatives to the magnetic sleeve 34 can include balanced transmission lines, isolated metal sleeves, and series inductive windings.

The magnetic sleeve 34 keeps the portion of the applicator system 10 that it covers electrically neutral. Thus, when the applicator 10 system is operated, electromagnetic radiation is concentrated within the ore region 4 because RF electric currents cannot flow over the outside of well pipe 20 due to the inductive reactance of magnetic sleeve 34. This is an advantage because it is desirable not to divert energy by heating the overburden region 2, which is typically highly conductive relative to the hydrocarbon ore region 4.

Some embodiments can include one or more electrical separations 40 in the applicator system 10. An electrical gap 42 is a section of the electrical cable where the shield has been stripped away and generally occurs near an insulator segment 22. An electrical gap 42 is similar to a connection site 26; however, no connection between the conductors and the conductive well pipe occurs at an electrical separation 40. The electrical separation 40 can be used to modify the electrical impedances obtained from the radiating segments 32. The electrical separations 40 change the load resistances provided by the radiating segments 32 and change the sign of the electrical reactance provided by radiating segments 32.

At an electrical separation 40, the radiating segments 32 are center fed, and the radiating segments become unfolded antennas that do not have DC continuity. Without the electrical separation 40, the radiating segments 32 are end fed, and the radiating segments become folded antennas having DC continuity. Thus, the radiating segments 32 can be made capacitive or inductive by including or not including electrical separations 40. Below the first resonance of the radiating segments 32, for example, at low frequencies, including electrical separations 40 can make the radiating segments capacitive. At higher frequencies, not including electrical separations 40 can make the radiating segments inductive and lower resistance, depending on the characteristics of the ore region 4. Electrical separations 40 can also be used to select between magnetic field induction and electric field induction heating modes in the ore region 4.

Figure 2:
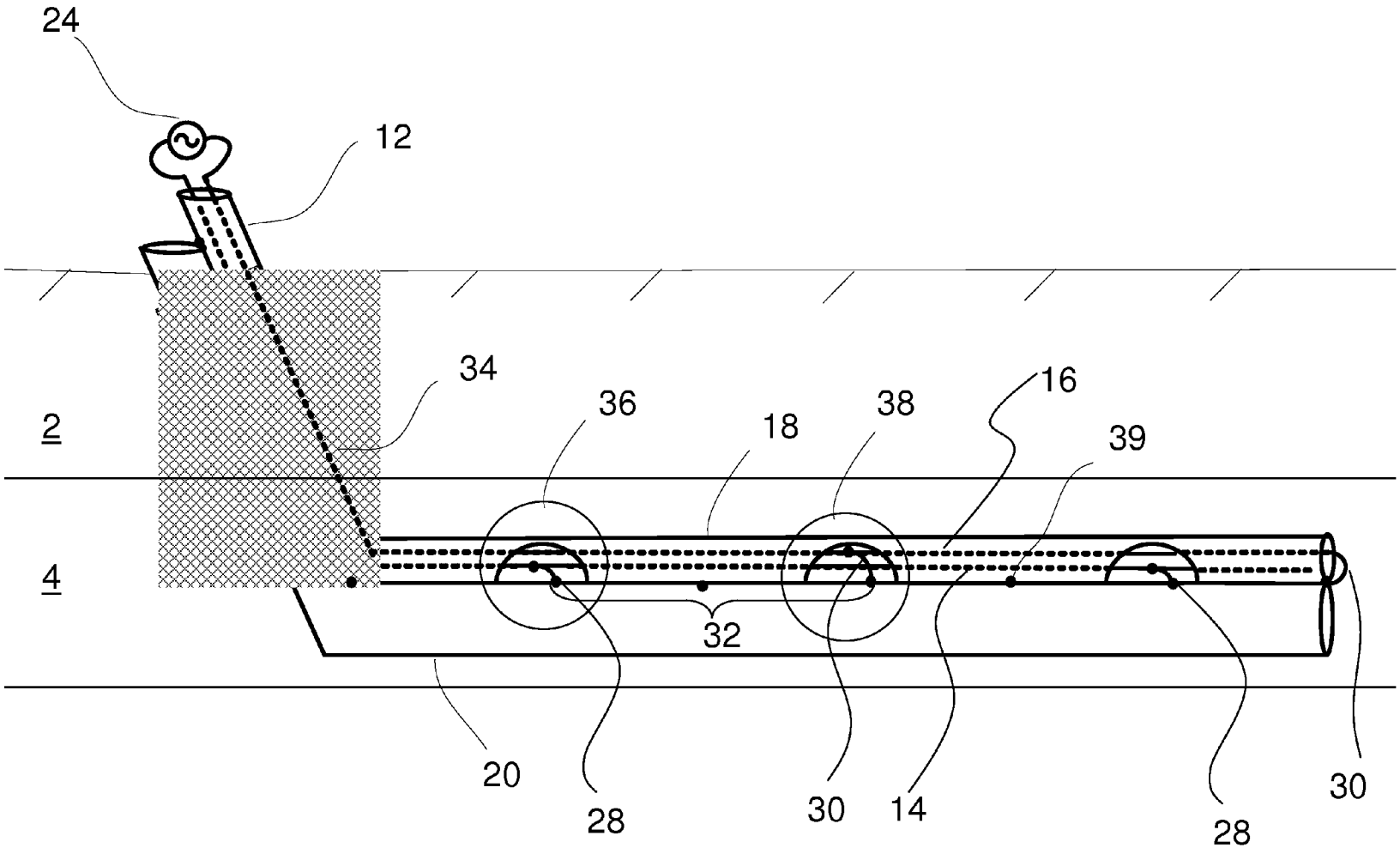
FIG. 2 is a diagrammatic perspective view of an alternative embodiment of a parallel fed well antenna array applicator system.

FIG. 2 shows an alternative embodiment of certain disclosed embodiments. In this embodiment, no insulator sections are installed in the conductive well pipe 20. Although this embodiment can allow for retrofitting existing oil wells, it is also less efficient and leads to more conductor loss.

The applicator system 10 of FIG. 2 includes an electrical cable 12, which has a first conductor 14, a second conductor 16, and a shield 18. The applicator also includes a conductive well pipe 20, an RF source 24, first connection sites 36, second connection sites 38, first conductive jumpers 28, second conductive jumpers 30, magnetic sleeve 34, and bond sites 36.

As described above with respect to FIG. 1, the electrical cable 12 has a first conductor 14, a second conductor 16, and a shield 18 and can be any known two conductor shielded cable. The conductive well pipe 20 can be made of any conductive metal, but in most instances will be a typical steel well pipe. The conductive well pipe 20 can include a highly conductive coating, such as copper. The RF source 24 also operates as explained above with respect to FIG. 1.

In this embodiment, the first conductor 14 is electrically connected to the conductive well pipe 20 at one or more first connection sites 36. A first connection site 36 is a section of the electrical cable 12 where the shield 18 has been stripped away to allow access to the first conductor 14 and the second conductor 16. In this embodiment, the first connection sites 36 occur at regular intervals but no corresponding insulator segment is present on the conductive well pipe 20. Again, the first conductor 14 can be connected to the conductive well pipe 20 through a first conductive jumper 28. The first conductive jumper 28 can be, for example, a copper wire, a copper pipe, a copper strap, or other conductive metal. The first conductive jumper 26 feeds current from the first conductor 14 onto the conductive well pipe 20.

Similarly, the second conductor 16 is electrically connected to the conductive well pipe 20 at one or more second connection sites 38. For example, the second conductor 16 can be connected to the conductive well pipe 20 through a second conductive jumper 30. The second conductive jumper 30 can be, for example, a copper wire, a copper pipe, a copper strap, or other conductive metal. Because current I flows in the opposite direction on the second conductor 16 as it does on the first conductor 14, the second conductor removes current I from the conductive well pipe 20.

In the illustrated embodiment, although this is not a requirement for other embodiments, each connection site alternates between being a first connection site 36 or a second connection site 38. Thus, along the length of the conductive well pipe 20 current I is fed onto and then removed from the conductive well pipe in an alternating fashion. The shield 18 is also bonded to the conductive well pipe 20 at regular, frequent intervals indicated as bond sites 39.

In operation, the first conductor 14, the first conductive jumper 28, the conductive well pipe 20, the second conductor 16, the second conductive jumper 30, create a closed electrical circuit, which is an advantage because the combination of these features allows the applicator system 10 to generate magnetic near fields so the antenna need not have conductive electrical contact with the ore. The closed electrical circuit provides benefits as described above with respect to FIG. 1. Moreover, the applicator system 10 operates in substantially the same manner as described above, and an array of radiating segments 32 is formed.

Simulations show that as the current I dissipates along the length of the conductive well pipe 32 as it flows, which creates a less effective magnetic field H at the far end of a radiating segment 32 with respect to the radio frequency source 24. Thus, the length of a radiating segment 32 can be about 35 meters or less for effective operation when the applicator 10 is operated at about 1 to 10 kHz. However, as described above the length of a radiating segment 32 can be greater or smaller depending on a particular applicator system 10 used to heat a particular ore region 4, and again because the applicator system 10 can extends one kilometer or more horizontally through the ore region 4, an applicator system can consist of twenty (20) or more radiating segments 32.

Once again a magnetic sleeve 34 surrounds the electrical cable 12 and the conductive well pipe 20 in, optionally throughout, the overburden region 2, which is an advantage because it is desirable not to divert energy by heating the overburden region 2, which is typically highly conductive.

Figure 3:
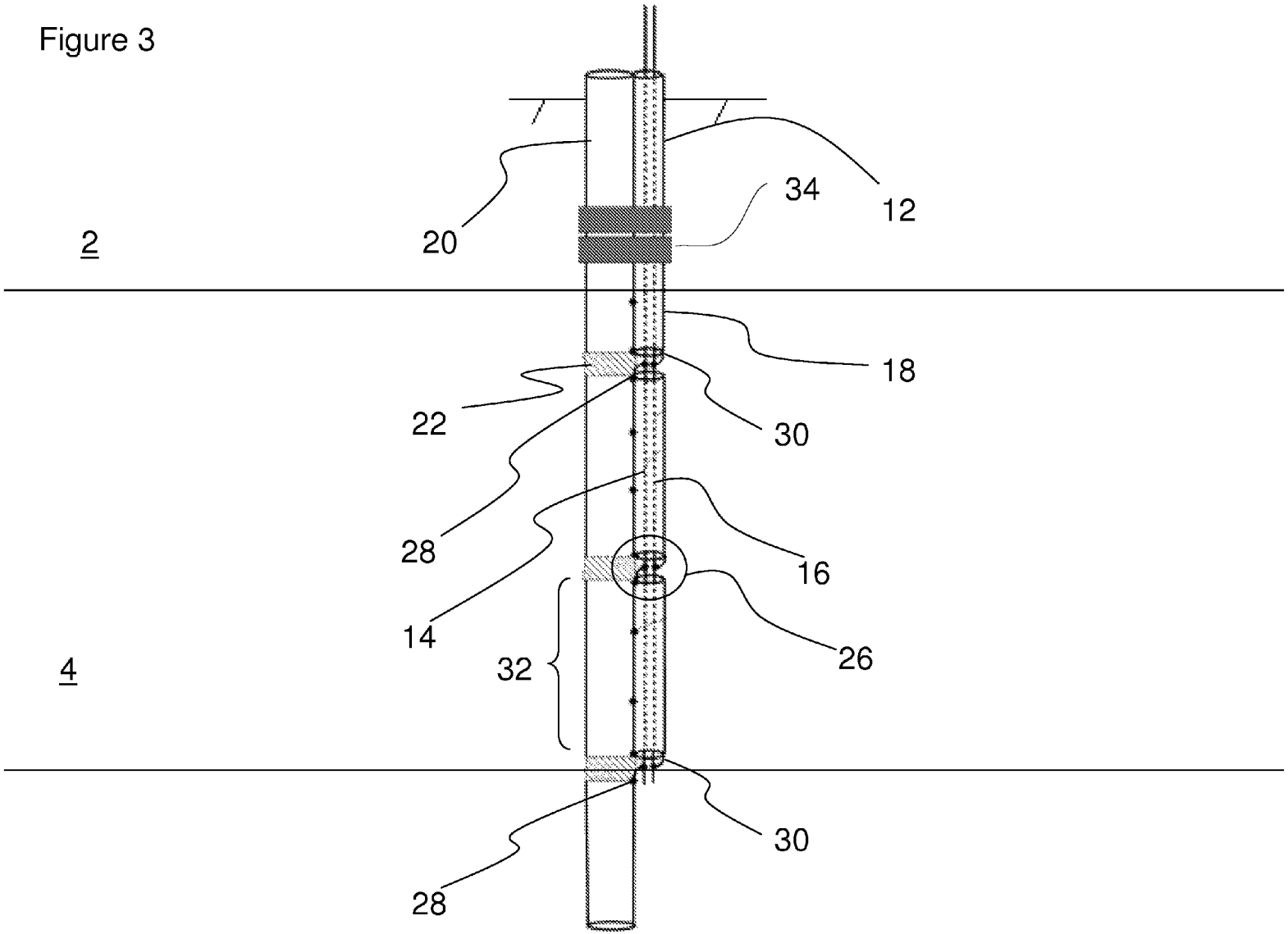
FIG. 3 is a diagrammatic perspective view of a vertical well embodiment of a parallel fed well antenna array applicator system.

FIG. 3 depicts yet another alternative embodiment. In this embodiment the applicator system 10 extends into a vertical well rather than a substantially horizontal well. This embodiment heats the ore region 4 in substantially the same manner as described above, however, because the well is vertical rather than horizontal, the effect will be slightly different because the magnetic fields will still expand radially from the conductive well pipe 20, and as such the magnetic fields will be generally oriented at a right angle to the magnetic field described above. The hydrocarbons can then be captured by one or more extraction pipes (not shown) located within or adjacent to the ore region 4, or the system can include pumps or other mechanisms to drain heated hydrocarbons.

Alternative embodiments to certain disclosed embodiments not shown are possible, for instance, the vertical well embodiment can be implemented without insulator segments 22, similar to that described above with respect to FIG. 2.

Figure 4:
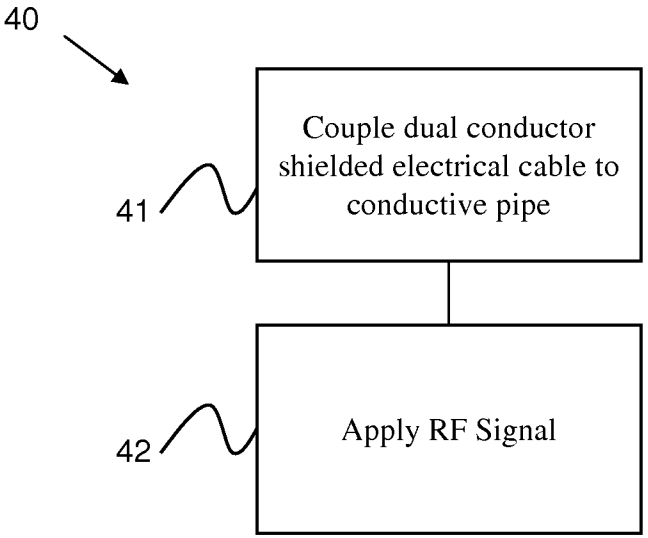
FIG. 4 is a flow diagram illustrating a method for heating a hydrocarbon formation through the use of a parallel fed well antenna array applicator system according to certain disclosed embodiments.

FIG. 4 depicts an embodiment of a method for heating a hydrocarbon formation 40. At the step 41, a two conductor shielded electrical cable is coupled to a conductive well pipe. At the step 42, a radio frequency signal is applied to the electrical cable, which is sufficient to create a circular magnetic field relative to the radial axis of the conductive well pipe.

At the step 41, a two conductor shielded electrical cable is coupled to a conductive well pipe. For instance, the electrical cable and the conductive well pipe can be the same or similar to the electrical cable 12 and the conductive well pipe 20 of FIG. 1, 2, or 3. Furthermore, the electrical cable is electrically coupled to the conductive well pipe. For instance, conductive jumpers can be used as described above with respect to FIG. 1, 2, or 3. The conductive well pipe is preferably located in the ore region of a hydrocarbon formation.

At the step 42, a radio frequency signal is applied to the electrical cable sufficient to create a circular magnetic field relative to the radial axis of the conductive well pipe. For instance, for the applicator systems depicted in FIGS. 1, 2, and 3, a 1 to 10 kilohertz signal having about 1 Watt to 5 Megawatts power can be sufficient to create a circular magnetic field penetrating about 10 to 15 meters half power depth radially from the conductive well pipe into the hydrocarbon formation, however, the prompt penetration depth and the signal applied can vary based on the composition of a particular hydrocarbon formation. The signal applied can also be adjusted over time to heat the hydrocarbon formation more effectively as susceptors within the formation are desiccated or replenished. The circular magnetic field creates eddy currents in the hydrocarbon formation, which will cause heavy hydrocarbons to flow.

A representative RF heating pattern in accordance with this invention will now be described. The FIG. 5 well dimensions are as follows: the horizontal well section is 1 kilometers long and at a depth of 30 meters, applied power is 1 Watt and the heat scale is the specific absorption rate in Watts/kilogram. The heating pattern shown is for time t=0, for example, when the RF power is first applied. The frequency is 1 kilohertz (which is sufficient for penetrating many hydrocarbon formations). Formation electrical parameters were permittivity=500 farads/meter and conductivity=0.0055 mhos/meter, which can be typical of rich Canadian oil sands at 1 kilohertz.

Figure 5:
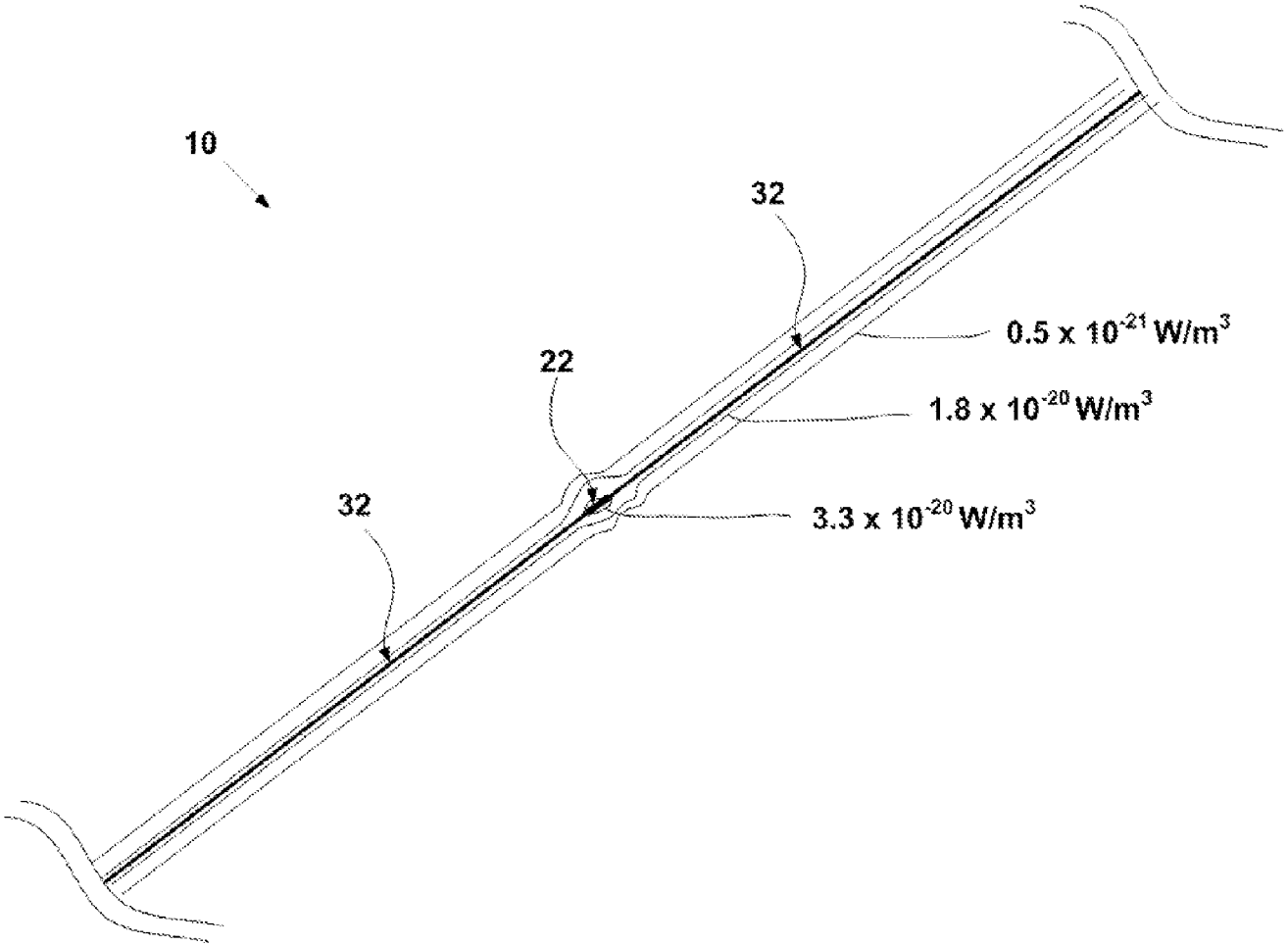
FIG. 5 is an overhead view of a representative RF heating pattern for a parallel fed well antenna array applicator system according to certain disclosed embodiments.

FIG. 5 depicts an isometric or overhead view of an RF heating pattern for a heating portion of two element array twinaxial linear applicator in accordance with this invention, which can be the same or similar to that described above with respect to FIG. 1. The heating pattern depicted shows RF heating rate of a representative hydrocarbon formation for the parameters described below at time t=0 or just when the power is turned on. 1 Watt of power was applied to the antenna applicator to normalize the data. As can be seen, the heating rate is smooth and linear along the conductive well pipe 20 because current is fed onto the conductive well pipe at regular intervals. The realized temperatures (not shown) are a function of the duration of the heating and the applied power, as well as the specific heat of the ore. Rich Athabasca oil sand ore was used in the model, and the ore conductivities used were from an induction resistivity log. A frequency of 1 kHz was applied. Raising the frequency increases the ore load electrical resistance reducing wiring gauge requirements, decreasing the frequency reduces the number of radiating segments 22 required. The heating is reliable as liquid water contact to the applicator system is not required. Radiation of waves was not occurring in the FIG. 5 example and the heating was by magnetic induction. The instantaneous half power radial penetration depth from the applicator system 10 can be 5 meters for lean Athabasca ores and 9 meters for rich Athabasca ores as the dissipation rate that provides the heating is increased with increased conductivity. Any heating radius can be accomplished over time by growing a steam bubble/steam saturation zone around the applicator system or by allowing for conduction and/or convection to occur. As the thermal conductivity of bitumen is low the speed of heating with certain disclosed embodiments can be much faster than steam at start up. The electromagnetic fields readily penetrate rock strata to heat beyond them, whereas steam will not. Thus at least two modes of heat propagation occur: prompt heating by electromagnetic fields and gradual heating by conduction and convection from the dissipated electromagnetic fields.

Figure 6:
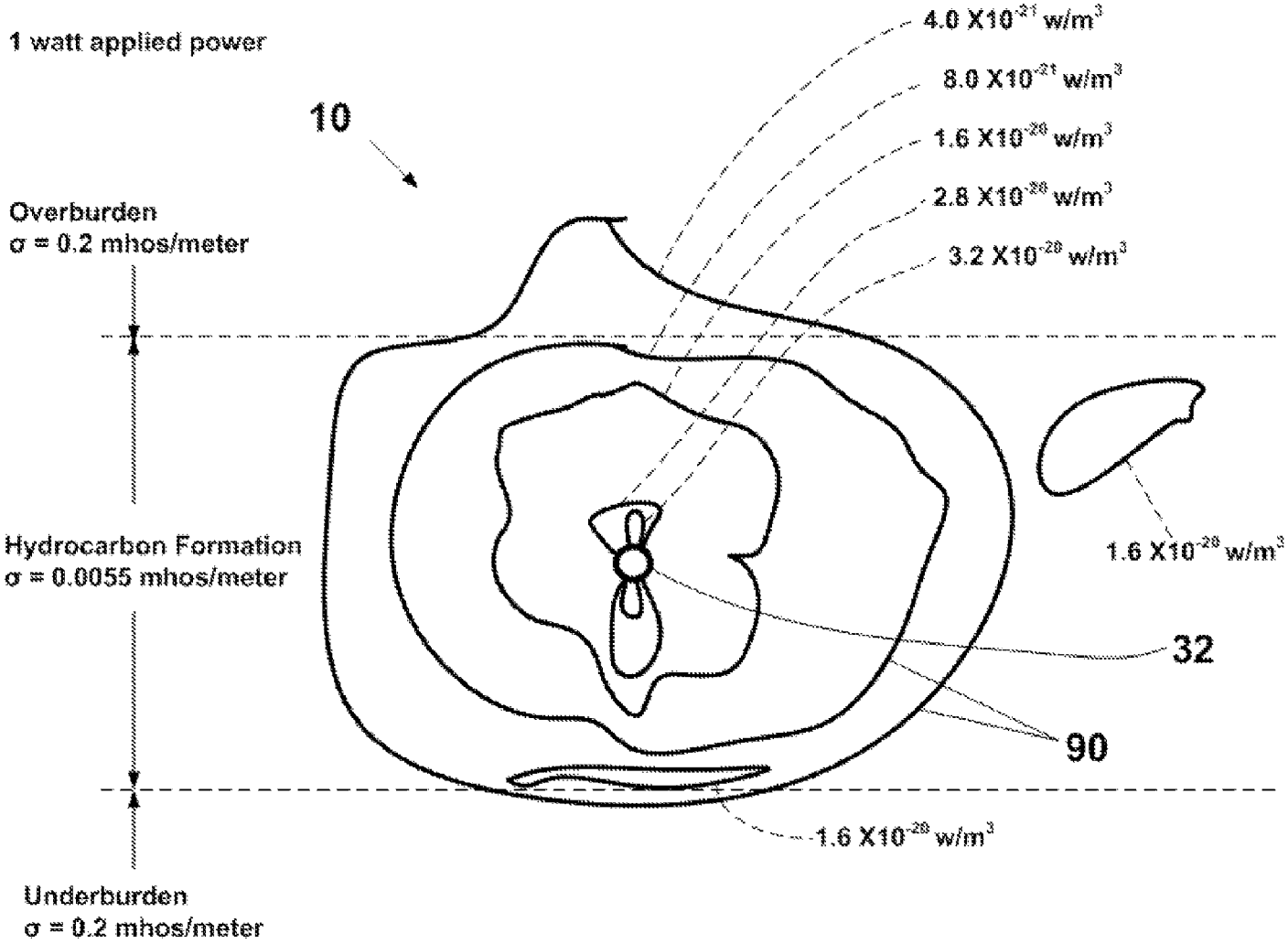
FIG. 6 is a cross sectional view of a representative RF heating pattern for a triaxial linear applicator according to certain disclosed embodiments.

FIG. 6 depicts a cross sectional view of an RF heating pattern for an applicator system 10 according to the same parameters. FIG. 6 maps the contours of the rate of heat application in watts per meter cubed at time t=0, for example, when the electric power has just been turned on. The antenna is being supplied 1 Watt of power to normalize the data. The ore is rich Athabasca oil sand 20 meters thick. Both induction heating by circular magnetic near field and displacement current heating by near electric field are evident. Numerical electromagnetic methods were used to perform the analysis which physical scale model test validated. Underground propagation constants for electromagnetic fields include the combination of a dissipation rate and a field expansion rate, as the fields are both turning to heat and the flux lines are being stretched with increasing radial distance and circumference. In certain disclosed embodiments, the radial field expansion/spreading rate is $1/r^2$. The radial dissipation rate is a function of the ore conductivity and it can be $1/r^3$ to $1/r^5$. The half power depth of the prompt RF heating energy, axially from the applicator 10 can be 10 meters or more depending on formation conductivity. The prompt effective heating length, axially along a single radiating segment 32 is about one radio frequency skin depth, although gradual heating modes can occur, which allows for any segment length. Precision of heat application corresponds with the number of applicator systems 10 and multiple applicator systems 10 can be utilized to form an underground array to control the range and shape of the heating.

Figure 7:
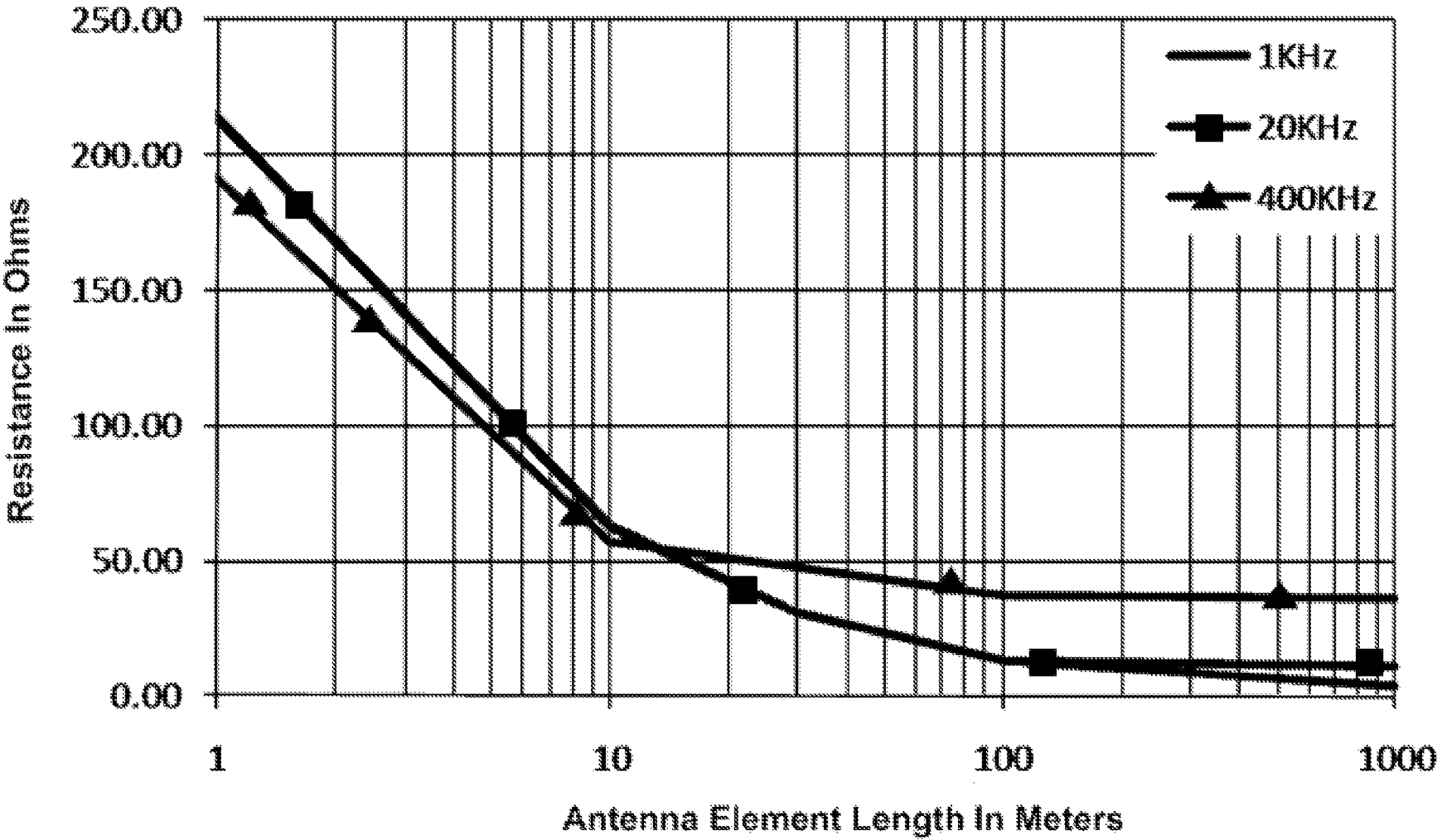
FIG. 7 is a graph of the representative resistance of an antenna element of the parallel fed well antenna array applicator system according to certain embodiments.

FIG. 7 shows the load resistance in ohms versus the length in meters of a center fed bare well pipe dipole immersed in rich Athabasca oil sand. The oil sand had a conductivity of 0.002 mhos per meter. In certain embodiments, FIG. 7 can be representative of the circuit properties of a single radiating segment 32. The electric current has just initially been applied and the well pipe conductor losses are not included in the figure. A typical length for radiating segment 32 in the rich Athabasca ore can be one (1) RF skin depth or 18 meters at 400 KHz. Thus, as depicted, a single dipole antenna element can deliver about 54 ohms of resistance. As the heating progresses, the salinity of the in situ water increases, the ore conductivity increases, and the antenna load resistance decreases (not shown). Finally, an underground saturation zone ("steam bubble") forms around the applicator system 10, the ore conductivity drops rapidly and the load resistance of the antenna rises rapidly by a factor of about 3 (not shown). The ending resistance of the single radiating segment 32 is about 162 ohms. The loss of liquid water contact with the applicator system 10 is not problematic due to the radio frequency and the inductive coupling of the single radiating segment 32 to the ore.

Raising and lowering the transmitter frequency to adjust the electrical coupling to the ore as it desiccates causes the applicator system 10 load resistance to adjust. Operating the transmitter at a critical frequency $F_c$ provides effective electrical coupling, so the power dissipated in the hydrocarbon ore exceeds the power lost in the antenna-applicator structure. The real dielectric permittivity $\in_r$ of the ore is much less important than the ore conductivity in determining antenna load resistance. This is because dielectric heating is negligible at relatively low radio frequencies in hydrocarbon ore, and there are no radio waves, just near fields. The electrical conductivity of Athabasca oil sand is inversely related to the oil content, so the richer (high oil content) ores have lower ore electrical conductivity. The electrical load resistance of the single radiating segment 32 is therefore less in leaner ores and higher in rich ores.

Figure 8:
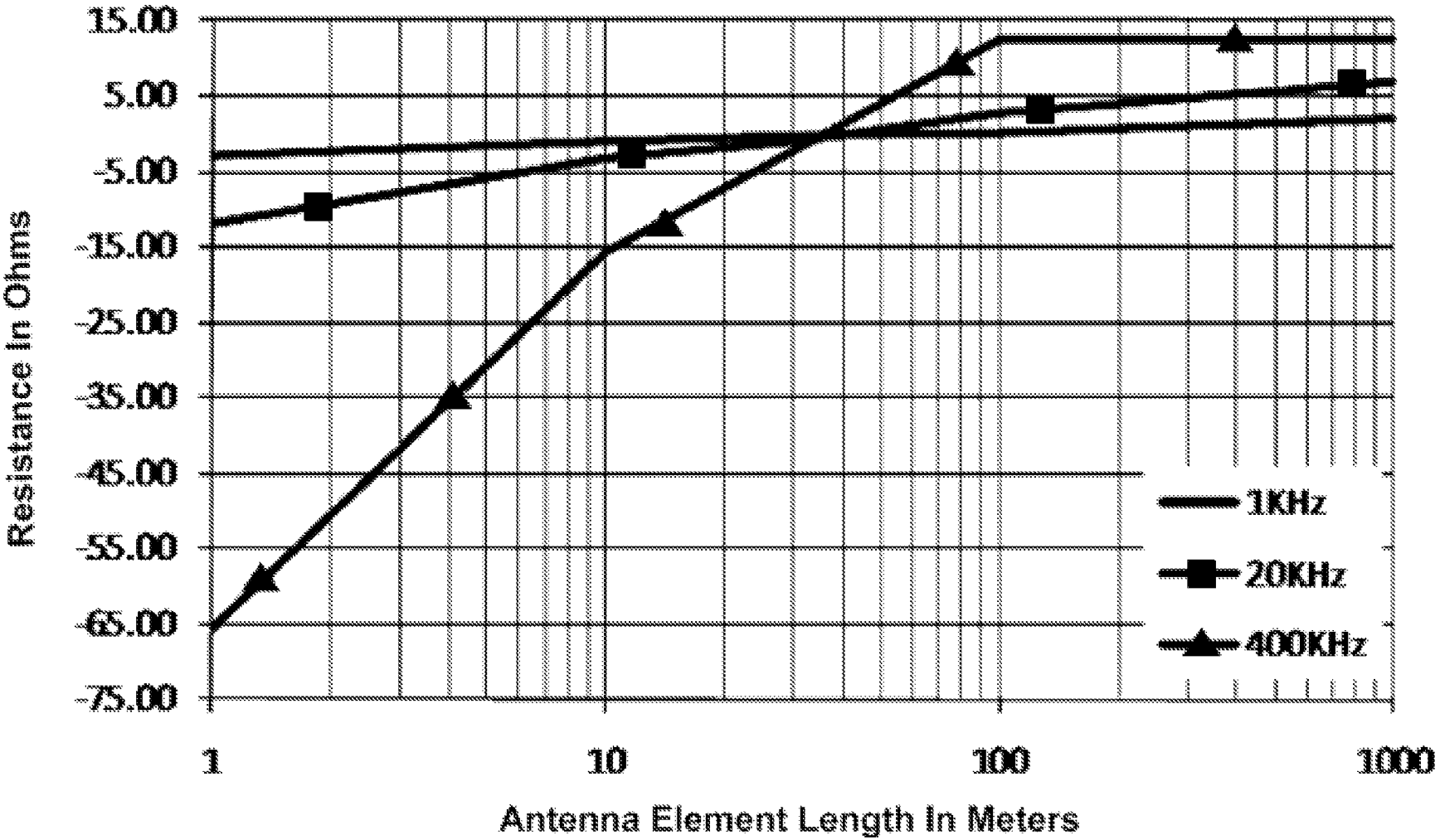
FIG. 8 is a graph of the representative reactance of an antenna element of the parallel fed well antenna array applicator system according to certain embodiments.

FIG. 8 is the driving point reactance in ohms versus length in meters of a center fed dipole of bare well pipe immersed in rich Athabasca oil sand having a conductivity of 0.002 mhos per meter. The electric current has just initially been applied and the well pipe is assumed to be a perfect electric conductor for simplicity. In certain embodiments, FIG. 8 can be representative of the circuit properties of a single radiating segment 32. A typical length for radiating segment 32 in the rich Athabasca ore can be one (1) RF skin depth, which is 18 meters at 400 KHz, so single dipole antenna element can deliver about 9 ohms of capacitive reactance. A method of the present invention is to operate the radiating segments 32 at their resonance frequency in the formation, for example, at a frequency where reactance of the radiating segments 32 is at zero (0) ohms. Operation at resonance advantageously reduces the power factor to minimize reactive power in the electrical cable 12 allowing for smaller conductor gauges to be used. A bare 35 meter long radiating segment 32 is resonant at 400 KHz and many other frequencies in rich oil sand.

Continuing to refer to FIG. 8 and for operation in rich Athabasca oil sand on 0.002 mhos/meter conductivity, the resonant length (35 meters) for radiating segments 32 is independent of frequency over a wide frequency range. Because of the dissipative nature of the oil sand media, the free space wavelength does not apply. A half wave resonant dipole in free space would be 367 meters long at 400 kHz yet in the oil sand 400 KHz resonance occurs at 35 meters length. The velocity factor in the oil sand is therefore about 1/10 that of free space at 400 KHz.

Although not so limited, heating from certain disclosed embodiments might primarily occur from reactive near fields rather than from radiated far fields. The heating patterns of electrically small antennas in uniform media can be simple trigonometric functions associated with canonical near field distributions. For instance, a single line shaped antenna, for example, a dipole, can produce a two petal shaped heating pattern cut due the cosine distribution of radial electric fields as displacement currents (see, for example, *Antenna Theory Analysis and Design*, Constantine Balanis, Harper and Roe, 1982, equation 4-20a, pp 106). In practice, however, hydrocarbon formations are generally inhomogeneous and anisotropic such that realized heating patterns are substantially modified by formation geometry. Multiple RF energy forms including electric current, electric fields, and magnetic fields interact as well, such that canonical solutions or hand calculation of heating patterns might not be practical or desirable.

Far field radiation of radio waves (as is typical in wireless communications involving antennas) does not significantly occur in antennas immersed in hydrocarbon formations. Rather the antenna fields are generally of the near field type so the electric flux lines begin and terminate on or near the antenna structure and the magnetic flux lines curl around the antenna. In free space, near field energy rolls off at a $1/r^3$ rate (where r is the range from the antenna conductor) and for antennas small relative wavelength it extends from there to $\lambda/2\pi$ (lambda/2 pi) distance, where the radiated field can then predominate. In the hydrocarbon formation 4, however, the antenna near field behaves much differently from free space. Analysis and testing has shown that heating dissipation causes the roll off to be much higher, about $1/r^5$ to $1/r^8$. This advantageously limits the depth of heating penetration in certain disclosed embodiments to substantially that of the hydrocarbon formation 4.

Several methods of heating are possible with the various embodiments. Conductive, contact electrode type resistive heating in the strata can be accomplished at frequencies below about 100 Hertz initially. In this method the antenna conductors comprise electrodes to directly supply electric current. Later, the frequency of the radio frequency source 24 can be raised as the in situ liquid water boils off the conductive well pipe 20 surfaces, which can continue heating which could otherwise stop as electrical contact with the formation opens. A method of certain disclosed embodiments is therefore to inject electric currents initially, and then to elevate the radio frequency to maintain energy transfer into the formation by using electric fields and magnetic fields, neither of which requires conductive contact with in situ water in the formation.

Another method of heating is by displacement current by the application of electric near fields into the underground formation, for example, through capacitive coupling. In this method the capacitance reactance between the applicator system 10 and the formation couples the electric currents without conductive electrode contact. The coupled electric currents then heat by Joule effect.

Another method of heating with certain disclosed embodiments is the application of magnetic near fields (H) into the underground strata to accomplish the flow of electric currents by inductive coupling and eddy currents. Induction heating is a compound process. The flow of electric currents through the radiating segments 32 forms magnetic fields around the radiating segments 32 according to Ampere's law, these magnetic fields form eddy electric currents in the ore by Lentz's Law, and the flow of these electric currents in the ore then heat the ore by Joule effect. The magnetic near field mode of heating is reliable as it does not require liquid water contact to the applicator system 10 and useful electrical load resistances are developed. The magnetic near fields curl around the axis of application system 10 in closed loops. In induction heating the equivalent circuit of the application system 10 is akin to a transformer primary winding and the hydrocarbon ore akin to the transformer secondary winding, although physical windings do not exist. Linear straight electrical conductors such as the present embodiments can be effective at producing magnetic fields.

Generally, in underground heating the real permittivity $\in'$ of the hydrocarbon ores is of secondary importance to the ore conductivity $\sigma$. Dielectric heating, as is common for microwaves, is not pronounced. Imaginary permittivity $\in''$ relates directly to the conductivity a according to the relation $\in'=j2\pi f\sigma$ where f is the frequency in Hertz.

Thus, the present invention can accomplish stimulated or alternative well production by application of RF electromagnetic energy in one or all of three forms: electric fields, magnetic fields and electric current for increased heat penetration and heating speed. The antenna is practical for installation in conventional well holes and useful for where steam can not be used or to start steam enhanced wells. The RF heating can be used alone or in conjunction with other methods and the applicator antenna is provided in situ by the well tubes through devices and methods described.

Figure 9:
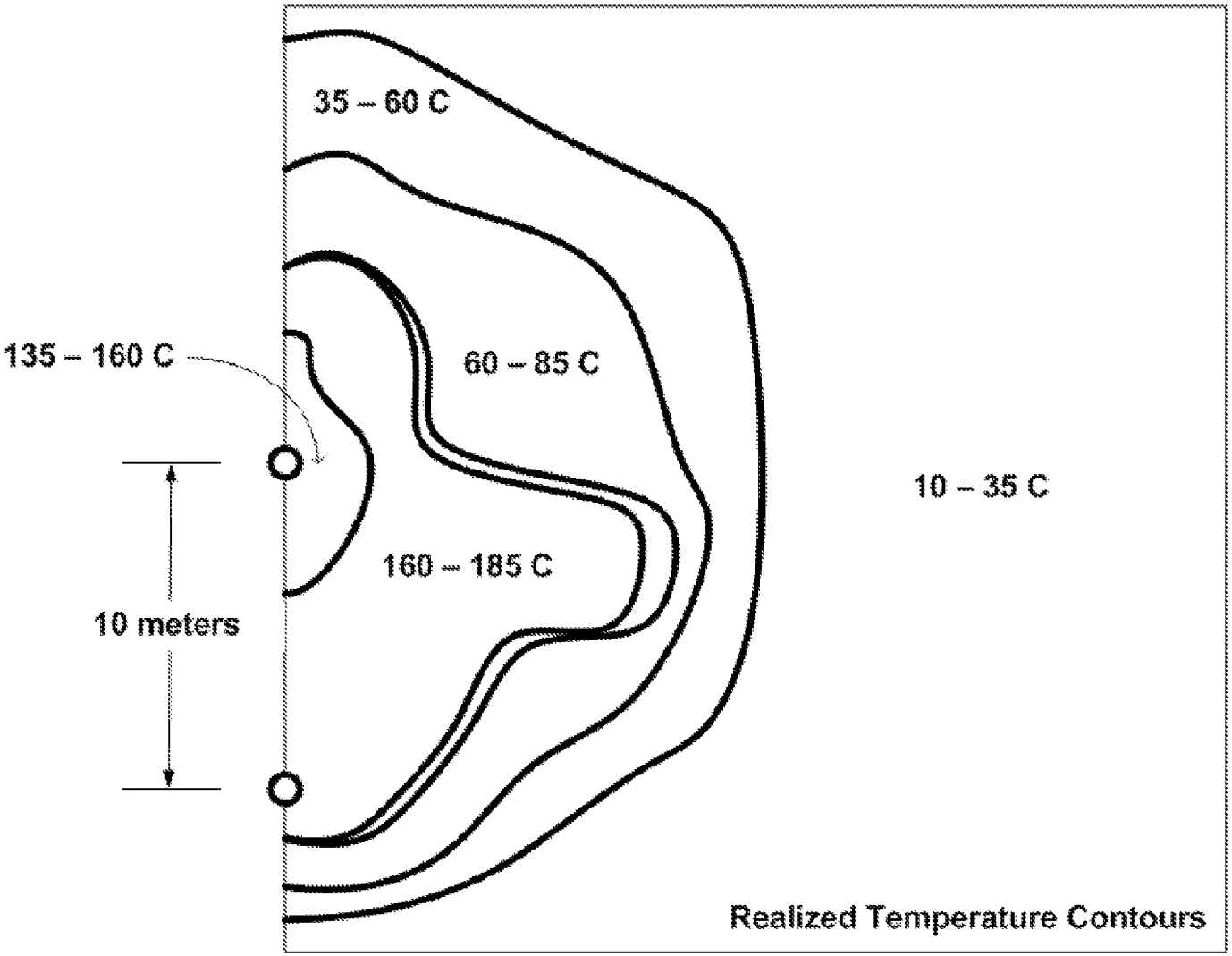
FIG. 9 is a contour plot example of the realized temperatures produced by certain embodiments.

FIG. 9 is a contour plot mapping realized temperatures produced by certain embodiments. FIG. 9 is merely exemplary: realized temperatures will vary from reservoir to reservoir depending on formation characteristics such as depth, the applied RF power, and the duration of the heating. Only the right half space is shown for efficiency in analysis and the left half space (not shown) is similar to the right. The units are in degrees Celsius and the time is 6 years after startup so the well system is in production. Start up might require weeks depending on the RF power. The view is a cross sectional view of a two hole embodiment well system using the applicator system 10. The upper hole contains the applicator system 10. The bottom hole is a producer well to drain the hydrocarbons and it can contain slits, pumps, and the like to drain the produced oil and lift it to the surface. The use of two holes is similar to the injector well-producer well geometry of a steam assisted gravity drainage (SAGD) system. A steam saturation zone ("steam bubble") can form around the applicator system 10 in the upper hole. This "steam bubble" grows to form an inverted triangle shaped region in which the liquid water is desiccated and the RF electromagnetic fields are free to expand because steam and sand are not lossy to electromagnetic fields. The realized temperatures do not exceed the boiling point of the liquid water at reservoir pressure, coking of the ore does not occur, and in practice the realized temperatures are sufficient to melt the bitumen for extraction. FIG. 9 relates to operation in a North American bitumen formation. In heavy oil formation, lower temperatures can be used.

Figure 10:
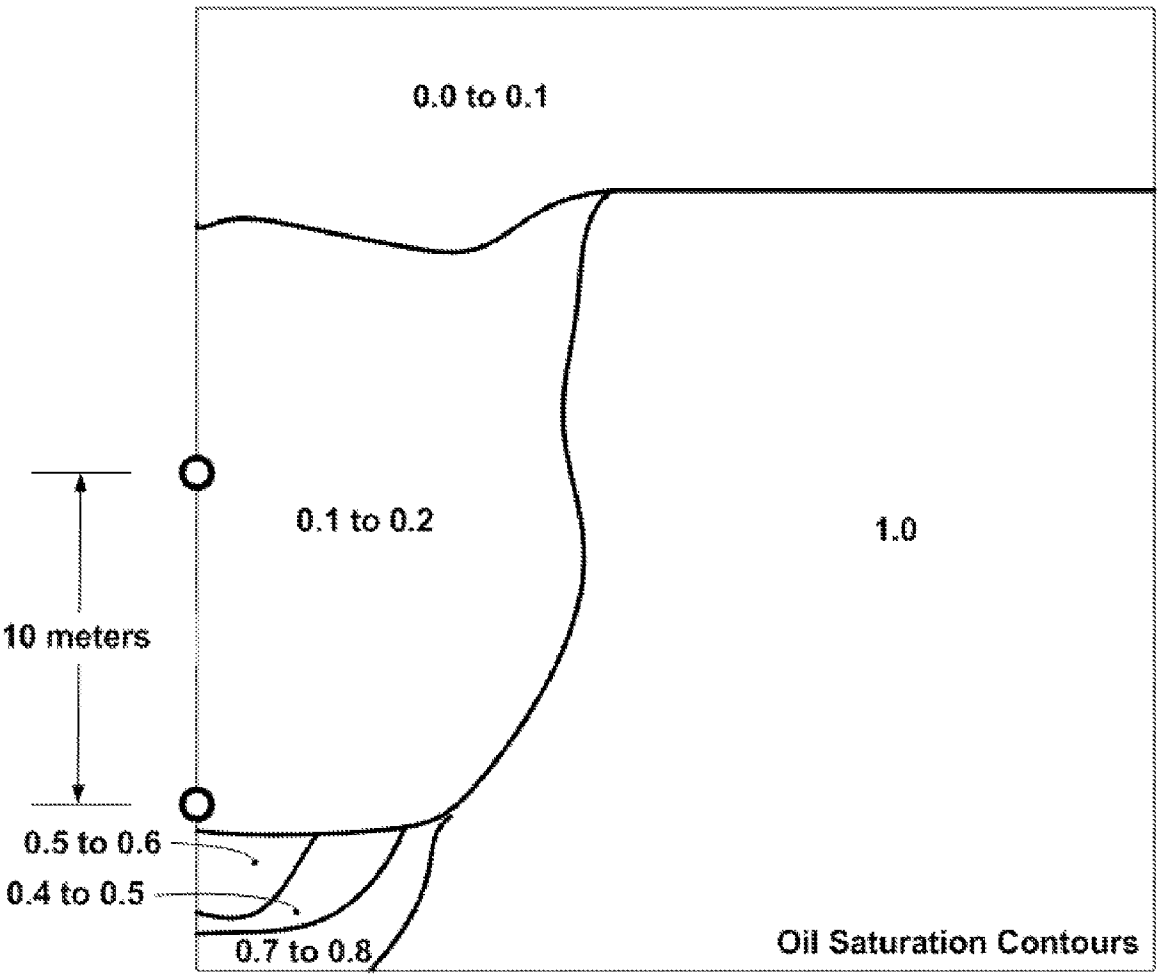
FIG. 10 is a contour plot example of the underground oil saturation of a well system using certain embodiments.

FIG. 10 depicts the oil saturation contours of a well system implementing certain embodiments after 6 years of production. Units of 1.0 mean all the original oil is in place and 0.0 unit regions contain no hydrocarbons. The bitumen drains at or ahead of the steam front, and the bitumen and connate water are produced together. About 80 percent of the bitumen in the formation was produced in the example and more or less bitumen can be produced depending on the rate of heating used, formation characteristics, co-injection of steam with RF, and many other factors. RF heated wells can produce faster than steam heated wells. As can be appreciated, increased speed can increase profits. With RF there is no need to wait for heat conduction to start heat convection, and thus, start up can be reliable. The propagation speed of RF heating energy in the ore is about the speed of light, so ore that is 10 or more meters from the applicator system 10 receives heating energy microseconds after RF power is turned on. The water saturation contours (not shown) for the heating example are somewhat similar to the FIG. 10 oil saturation contours, although the dry zone tends to grow more vertically.

Although preferred embodiments have been described using specific terms, devices, and methods, such description is for illustrative purposes only. The words used are words of description rather than of limitation. It is to be understood that changes and variations can be made by those of ordinary skill in the art without departing from the spirit or the scope of the present invention, which is set forth in the following claims. In addition, it should be understood that aspects of the various embodiments can be interchanged either in whole or in part. Therefore, the spirit and scope of the appended claims should not be limited to the description of the preferred versions contained herein.

The invention claimed is:

1. A device for heating a hydrocarbon formation comprising:

an electrically conductive pipe having one or more radiating segments and one or more insulator segments interposed between said radiating segments;

an electrical cable positioned adjacent to the electrically conductive pipe having a first conductor, a second conductor spaced apart from and electrically insulated from the first conductor, and a shield surrounding the first conductor and the second conductor, the shield having at least one discontinuity exposing the first conductor and the second conductor creating a connection site adjacent to an insulator segment;

a radio frequency source connected to the first conductor and the second conductor and configured to apply a signal to the electrical cable;

a nonconductive sleeve positioned around the electrically conductive pipe and the electrical cable prior to at least one insulator segment relative to the radio frequency source; and wherein at the connection site the first conductor is electrically connected to the conductive pipe just beyond an insulator segment and the second conductor is electrically connected to the shield.

2. The device of claim 1, wherein the shield has one or more electrical gaps exposing the first and second conductor adjacent an insulator segment creating an electrical separation.

3. The device of claim 1, wherein the electrically conductive pipe extends horizontally through an ore region of the hydrocarbon formation.

4. The device of claim 1, wherein the electrically conductive pipe extends vertically down into the hydrocarbon formation and passes through an ore region of the hydrocarbon formation.

5. The device of claim 1, wherein the electrically conductive pipe including the radiating segments comprises steel pipe.

6. The device of claim 1, wherein the nonconductive sleeve is positioned around the electrically conductive pipe and the electrical cable through at least a portion of an overburden region of the hydrocarbon formation.

7. The device of claim 1, wherein the radio frequency source is configured to apply the signal between 1 kilohertz and 10 kilohertz.

8. An applicator for heating a hydrocarbon formation comprising:

an electrically conductive pipe to be positioned within the hydrocarbon formation;

an electrical cable adjacent the electrically conductive pipe and comprising a first conductor, a second conductor spaced apart from and electrically insulated from the first conductor, and a shield surrounding the first conductor and the second conductor, the shield having a plurality of discontinuities along a medial portion thereof exposing the first conductor and the second conductor defining a plurality of first connection sites and at least one second connection site arranged in an alternating arrangement of first and second connection sites;

a radio frequency source connected to the first conductor and the second conductor, and configured to apply a signal to the electrical cable; and wherein the first conductor is electrically connected to the electrically conductive pipe at the first connection sites and the second conductor is electrically connected to the conductive pipe at the second connection sites.

9. The applicator of claim 8, wherein the conductive pipe extends horizontally through an ore region of the hydrocarbon formation.

10. The applicator of claim 8, wherein the conductive pipe extends vertically into the hydrocarbon formation and passes through an ore region of the hydrocarbon formation.

11. The applicator of claim 8, where the conductive pipe comprises steel pipe.

12. The applicator of claim 8, further comprising a nonconductive sleeve positioned around the electrically conductive pipe and the electrical cable prior to the plurality of discontinuities relative to the radio frequency source; and wherein the nonconductive sleeve is positioned around the electrically conductive pipe and the electrical cable through at least a portion of an overburden region of the hydrocarbon formation.

13. The applicator of claim 8, wherein the radio frequency source is configured to apply the signal applied is between 1 kilohertz and 10 kilohertz.

14. A method for applying heat to a hydrocarbon formation comprising:

coupling an electrical cable to a conductive well pipe in the hydrocarbon formation at a plurality of first connection sites and at least one second connection site arranged in an alternating arrangement of first and second connection sites defined by a plurality of discontinuities along a medial portion of a shield of the electrical cable, the shield surrounding first and second spaced apart and electrically insulated conductors, wherein coupling comprises coupling the first conductor to the conductive well pipe at the first connection sites and coupling the second conductor to the conductive well pipe at the second connection sites; and applying a radio frequency signal to the electrical cable creating a circular magnetic field relative to a radial axis of the conductive well pipe.

15. The method of claim 14, comprising applying the radio frequency signal applied to the electrical cable at a frequency between 1 kilohertz and 10 kilohertz.

* * * * *